United States Patent [19]

Lock et al.

[11] 4,048,900

[45] Sept. 20, 1977

[54] EXTRACTION ASSEMBLY

[76] Inventors: William E. Lock, 183 Wygant Road, Horseheads, N.Y. 14845; Charles J. Churillo, 221 Gilda Place, Fort Walton Beach, Fla. 32548

[21] Appl. No.: 697,663

[22] Filed: June 18, 1976

[51] Int. Cl.[2] ..... F42B 39/10

[52] U.S. Cl. ..... 86/48; 214/1 BB

[58] Field of Search ..... 89/1 L, 34; 86/45–48; 214/1 BB, 1.1, 8.5 A, 8.5 C

[56] References Cited

U.S. PATENT DOCUMENTS 220,545 10/1879 Palmcrantz ..... 89/1 L

*Primary Examiner*—Stephen C. Bentley

*Attorney, Agent, or Firm*—Joseph E. Rusz; Arsen Tashjian

[57] ABSTRACT

An assembly adapted to perform sequentially the following: to extract horizontally rounds of ammunition from containers that are being indexed downwardly by a vertical conveyor; to position the extracted rounds of ammunition over a horizontal conveyor; and, to insert these rounds vertically downward into individual round-carrier elements of the horizontal conveyor. The preferred embodiment of the extraction assembly includes nine identical ammunition round extractor-release mechanisms (i.e., extractors), an extractor bar in which the nine extractors are mounted side-by-side, an extractor bar drive mechanism operatively connected to the extractor bar, an extractor roller element, and a horizontal extractor table with a drop-off section. The extractor bar operates in a horizontal back-and-forth motion to thrust the extractors forwardly into the ammunition container, and then pull the extractors backwardly together with the rounds of ammunition respectively gripped, held, and extracted by the individual extractors. Each extractor has: two spring-load finger elements that grasp the particular round by the extractor grooves on the round, and pull the round out of the ammunition container; and, two sliding finger elements that hold the round of ammunition from the bottom and then slide out of the way to release control of the round and drop it into moving round-carrier elements of the horizontal conveyor. The extraction assembly, and more particularly the extractors, may be adapted and utilized to handle items other than rounds of ammunition such as, for example, bottles or cans.

3 Claims, 3 Drawing Figures

FIG. 1
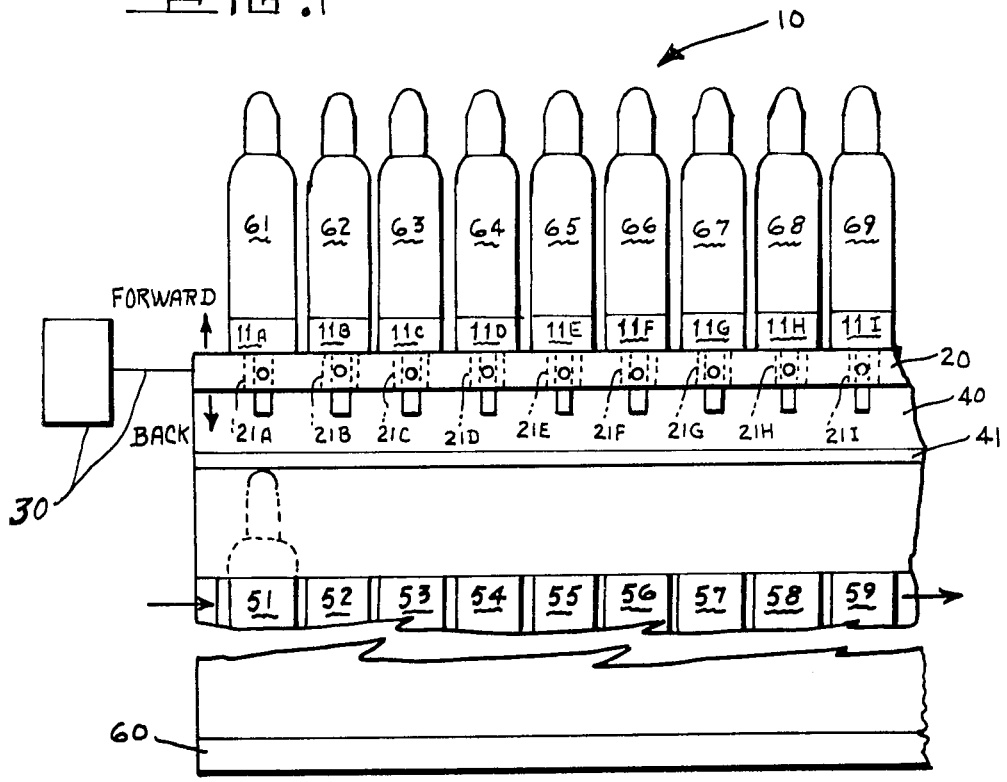
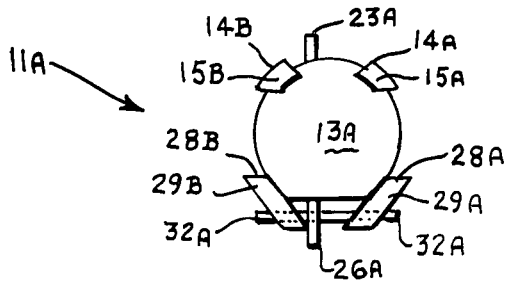
FIG. 3
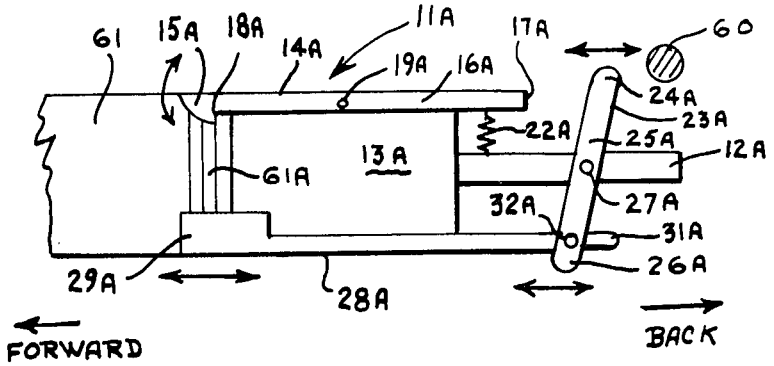
FIG. 2

EXTRACTION ASSEMBLY

STATEMENT OF GOVERNMENT INTEREST

The invention described herein may be manufactured and used by or for the Government for governmental purposes without the payment of any royalty thereon.

CROSS REFERENCE TO RELATED APPLICATION

The extraction assembly (and, more specifically, the extractor-release mechanism, or extractor) taught herein may be used as a cooperating component in the inventive system set forth in copending application entitled, "Automated Ammunition Loading/Downloading System", filed on even date herewith and having U.S. patent application Ser. No. 697,662.

BACKGROUND OF THE INVENTION

This invention relates to an extraction assembly and, more particularly, to an adaptation thereof for use in horizontally extracting a preselected plurality of rounds of ammunition (from the standarized ammunition containers presently in use) while the containers are being indexed downwardly in a vertical conveyor; then positioning the rounds of ammunition over carrier elements of the horizontal conveyor; and, then inserting the rounds vertically downward into the individual carrier elements of the moving horizontal conveyor.

One particular application of such an adaptation of our extractor-release assembly is illustrated in our copending application entitled, "Automated Ammunition Loading/Downloading System".

This invention permits the above-described extraction, positioning, and inserting of rounds of ammunition, as described above, in the manner required in our above-mentioned, "Automated Ammunition Loading-/Downloading System", i.e., in a repetitive cycle during which nine individual rounds of ammunition are required to be extracted, properly positioned, and timely inserted. Our inventive extraction assembly not only meets this pressing need, but also is very easily adaptable to other uses in other environments to meet other long-standing needs, such as handling bottles and cans.

We have, thereby, significantly advanced the state-of-the-art.

SUMMARY OF THE INVENTION

This inventive extraction assembly pertains to a particular preferred embodiment adapted for use in extracting, in a cyclic manner, nine rounds of ammunition from standard ammunition containers, precisely positioning the extracted rounds, and then placing the rounds on moving individual round-carriers.

Accordingly, the principal object of this invention is to teach the structure of such a preferred embodiment of the invention.

Another object of this invention is to teach the structure of a unique extractor-release mechanism (hereinafter referred to as "extractor"), which is the major component of our extraction assembly, and which performs the sequential complex tasks of grasping, gripping, holding, and releasing each round of ammunition, but which is nevertheless simple in structure, reliable, and easy and economical to manufacture.

These objects, as well as other related objects, of this invention will become readily apparent after a consideration of the description of our invention, coupled with reference to the Figures of the drawing.

DESCRIPTION OF THE DRAWINGS

FIG. 1 is a simplified representation, partially pictorial, partially schematic, and partially fragmented, of a preferred embodiment of our invention as adapted for the use previously mentioned herein;

FIG. 2 is a side elevation view, in simplified form, of the extraction-release mechanism component (i.e., "extractor") of our invention, shown during that stage of operation where it has gripped and is holding a representative round of ammunition; and, FIG. 3 is an end view, in simplified form, of the extractor-release mechanism component (i.e., "extractor") shown in FIG. 2, without the representative round of ammunition.

DESCRIPTION OF THE PREFERRED EMBODIMENT

With reference to FIG. 1, therein is shown a preferred embodiment 10 of our invention. In it's most simple and generic form, the preferred embodiment comprises: a plurality of extractor-release mechanisms (hereinafter referred to as "extractors"), preferably nine (9) for the function intended, such as representative ones 11A–11I, inclusive; a movable extractor bar 20 (which has a plurality of openings therethrough, preferably nine 21A–21I, inclusive) to which each of the said plurality of extractors, such as 11A–11I, are mounted in a side-by-side relationship; means 30 for moving (or otherwise driving) the extractor bar 20; an extractor roller 60, to the rear of and above, the extractor bar 20; and, an extractor-release table 40 disposed below the plurality of extractors, with the table 40 having a "drop-off" section 41.

Also shown in FIG. 1 are nine representative rounds of ammunition 61–69 being held individually by separate and distinct extractors (e.g., round 61 by extractor 11A, round 62 by extractor 11B, and so forth) after having been extracted from a standard ammunition container (i.e., box), not shown.

Still with reference to FIG. 1, also shown therein are individual single-round carrier elements, such as representative ones 51–59, inclusive, of a horizontal conveyor 50. The carrier elements are disposed below, and aft of, the original position of the rounds of ammunition (and, of course, the "drop off" portion 41 of the stationary table 40); and, the conveyor round-carrier elements are movable.

With reference to FIG. 2, therein is shown a representative extractor 11A of the plurality of extractors 11A–11I, shown in FIG. 1. The extractor 11A is enlarged and not to scale, in order to better show the elements thereof. As can be easily seen, the extractor 11A, as well as the other extractors of the plurality, comprise: a support shaft 12A; a body 13A that is essentially cylindrical in shape and is attached to the support shaft 12A; a plurality of movable finger-like grasping elements, such as representative one 14A, having a first end 15A, a middle portion 16A, and a second end 17A, with the first end 15A having a hook-like projection 18A, the middle portion 16A pivotally connected by suitable means, such as pin 19A, to the cylindrical body 13A, and the second end 17A biased by suitable means, such as spring 22A, to the support shaft 12A; an actuation lever 23A, having a first end 24A, a middle portion 25A, and a second end 26A, with the middle portion 25A pivotally connected by suitable means, such as pin 27A, to the support shaft 12A; and, at least one (and, preferably, two) finger-like slide elements, such as representative one 28A, having a first end 29A and a second end 31A, with the second end 31A pivotally connected to the first end 26A of the actuation lever 23A by suitable means, such as pin 32A, and with the finger-like slide element 28A abutting with and slidably movable along the cylindrical body 13A, as indicated by the two-headed arrow.

Also shown in FIG. 2 is representative round of ammunition 61 which, like the other representative rounds, has extractor grooves 61 where the finger-like grasping elements, such as 14A, grip and releasably hold the individual round, such as 61, by the hook-like projection 18A of the finger-like element 14A.

Still with reference to FIG. 2, and more particularly with regard to grasping element 14A, said element is movable upwardly or downwardly, as clearly ascertainable from its structural linkage with spring 22A, support shaft 12A, and actuation lever 23A and with body 13A via pivot 19A, and as shown by the two-headed arc-like arrow near first end 15A.

Also shown in FIG. 2 is a cross section of extractor roller 60, previously shown length-wise in FIG. 1. As can be seen, the extractor roller 60 is positioned at a height at which the actuation lever, such as representative one 23A, will strike the extractor roller 60.

Now, with reference to FIG. 3, which is a simplified end view of representative extractor 11A, but without representative round 61 being held therewith, the positional relationships of body 13A, grasping elements 14A and 14B with their respective hook-like projections 15A and 15B, sliding elements 28A and 28B and their respective first ends 29A and 29B, and actuation lever 23A with pin 32A, can be very easily seen.

MANNER OF OPERATION OF THE PREFERRED EMBODIMENT

With reference to FIGS. 1-3, inclusive, the manner of operation of the preferred embodiment may be simply, but accurately, described as follows:

The extractor bar 20 is operated back-and-forth, by the moving means 30, from an ammunition container (not shown) to across the extractor table 40. It is here to be remembered that the standarized ammunition container houses four horizontal rows (in registration and in layered fashion) of nine rounds of ammunition per row. Therefore, as a matter of preference (or need), rather than as any limitation of our invention, our extraction assembly is cyclic with every row of ammunition or, stated another way, with every nine rounds of ammunition. When the extractor bar 20 is thrust toward the ammunition container (not shown, but located forward of the extraction assembly), the attached extractors 11A-11I are thrust into the ammunition container. Then, each of the nine extractors 11A-11I grasps one of the nine rounds, such as 61-69, FIG. 1. More specifically, the two movable spring-loaded finger-like elements, such as representative ones 14A and 14B, FIG. 3, of each extractor, such as representative one 11A, FIGS. 1-3, grasps its individual one round, such as 61, FIGS. 1 and 2, by and at the extractor grooves, such as 61A, of the round; and, holds the round, such as 61. When the extractor bar 20 is moved back by the moving means 30, the attached extractors 11A-11I move (perpendicularly to the motion of the horizontal conveyor round-carrier elements, such as 51-59) back across the extractor-release table 40 and the "drop-off" portion 41 of the table, and out over the moving single-round carrier conveyor elements 51-59. As the tip of the rounds of ammunition, such as 61, simultaneously reach the "drop-off" (as shown in phantom in FIG. 1 with regard to representative round 61), the extractors 51-59 simultaneously release their respective rounds, and the rounds drop into their corresponding individual conveyor element (for example: round 61 drops into conveyor element 51, round 62 drops into conveyor element 52, and so on). It is to be noted in this regard, that the extractors, such as 11A-11I, operate at a sufficient height above the conveyor elements, such as 51-59, to eliminate any interference between the extractors (as they return for another nine rounds of ammunition) and the rounds that have just been released and that now are moving beneath the extractors, at right angles to the return movement of the extractors.

With regard to the release of the rounds 61-69 by the extractors 11A-11I at the "drop-off" 41, what more specifically occurs is that the actuation lever for each extractor (such as 23A, FIG. 2, for extractor 11A) strikes the extractor roller 60 and is pivotally moved forward, as the extractor continues to move backward, beyond the extractor roller 60. When the actuation lever, such as 23A, is moved back, the sliding finger elements (such as 28A and 28B, FIG. 3) are slidably pulled back, thereby sliding out of the way of the grasped round and, in effect, releasing the round by permitting it to drop off the extractor and drop down.

Of course, when the extractor bar 20 is moved forward, the attached extractors 11A-11B are also moved forward. Then, the respective actuation lever, such as 23A, strike the extractor roller 60, causing the slidable finger elements, such as 28A and 28B, of the extractor, such as 11A, to slide forwardly in the "hold position", so that the extractors as a whole are now operatively and structurally ready to grasp, grip and hold other rounds when thrust forwardly into the ammunition container.

As previously implied and stated, this entire sequence is cyclic.

CONCLUSION

It is very clearly evident from all of the foregoing, and from the contents of the Figures of the drawings herein, that the stated objects, and other related objects, of our invention have been attained.

It is to be noted that, although there have been described the fundamental and unique features of our inventive extraction assembly, as applied to a particular preferred embodiment that is adapted for a specific use, various other embodiments, adaptations, substitutions, additions, omissions, and the like may occur to, and may be made by, those of ordinary skill in the art, without departing from the spirit of our invention. For example, the means for moving the extractor bar 20 in the desired back-and-forth motion may be of varied structure of which one variation comprises: a drive plate attached to each of the two ends of the extractor bar 20, with cam follower rollers mounted on each drive plate; an endless chain operatively connected to each drive plate to drive the drive plate (and the extractor bar to which the plates are attached) in a shuttling back-and-forth motion; and, a cam plate for each drive plate, with each cam plate running the length of the extractor bar motion, and with each cam plate having therein and therethrough cam paths (to be followed by the cam follower rollers) contoured to impart a vertical motion to the extractor bar 20 to move it vertically downward as the rounds are pulled out across the "drop-off" surface and over the moving horizontal conveyor round-carrier elements.

What is claimed is:

1. An extractor-release assembly, comprising:

a. a plurality of extractor-release mechanisms, wherein each of said plurality of extractor-release mechanisms is identical and includes:

1. a support shaft;
2. a cylindrical body attached to said support shaft;
3. a plurality of finger-like grasping elements having a first end, a middle portion, and a second end, with the first end having a hook-like projection, the middle portion pivotally connected to said cylindrical body, and the second end biased to said support shaft;
4. an actuation lever having a first end, a middle portion, and a second end, with said middle portion pivotally connected to said support shaft;
5. and, at least one finger-like slide element having a first end and a second end, with said second end pivotally connected to said first end of said actuation lever, and with said finger-like slide element abutting with and slidably movable along said cylindrical body;

b. a movable extractor bar to which each of said plurality of extractor-release mechanisms are mounted in a side-by-side relationship;

c. means for moving said extractor bar;

d. means for causing said extractor-release mechanisms to extract and to release;

e. and, an extractor-release table disposed below said plurality of extractor-release mechanisms, with said table having a drop-off section.

2. An extractor-release assembly, as set forth in claim 1, wherein each of said plurality of extractor-release mechanisms comprises:

a. two finger-like grasping elements;

b. and, two finger-like slide elements.

3. An extractor-release assembly as set forth in claim 1, wherein said means for causing said extractor-release mechanisms to extract and release includes an extractor roller, to the rear of and above said extractor bar, positioned at a height at which said actuation levers will strike the extractor roller.

* * * * *